United States Patent [19]

Gideon

[11] 3,964,105

[45] June 22, 1976

[54] KNOT SIMULATOR

[76] Inventor: Thomas R. Gideon, P.O. Box 399, Aztec, N. Mex. 87410

[22] Filed: Mar. 24, 1975

[21] Appl. No.: 561,425

[52] U.S. Cl. ..... 2/152 R; 24/49 CC

[51] Int. Cl.[2] ..... A41D 25/14

[58] Field of Search ..... 2/152 R, 152 A, 148, 2/149, 150, 151, 153; 24/49 R, 49 KC, 49 CC, 49 C, 49 P

[56] References Cited

UNITED STATES PATENTS

| | | | |
|---|---|---|---|
| 384,036 | 6/1888 | Hellenberg | 2/152 R |
| 527,129 | 10/1894 | Sanguinette | 2/150 |
| 1,349,486 | 8/1920 | Bakerman | 2/150 |
| 1,887,104 | 11/1932 | Roberts | 2/150 |
| 2,349,842 | 5/1944 | Barreto | 2/153 |

FOREIGN PATENTS OR APPLICATIONS

| | | | |
|---|---|---|---|
| 521,666 | 3/1955 | Italy | 2/150 |

*Primary Examiner*—H. Hampton Hunter
*Attorney, Agent, or Firm*—Sughrue, Rothwell, Mion, Zinn & Macpeak

[57] ABSTRACT

A knot simulator has a shield with top and bottom sections. The inner surface of the shield carries upper spring clips on the top section, and an enlarged clasp spans the bottom section. The clips and the clasp cooperatively hold the panels of a necktie behind the shield to simulate a tied appearance.

1 Claim, 5 Drawing Figures

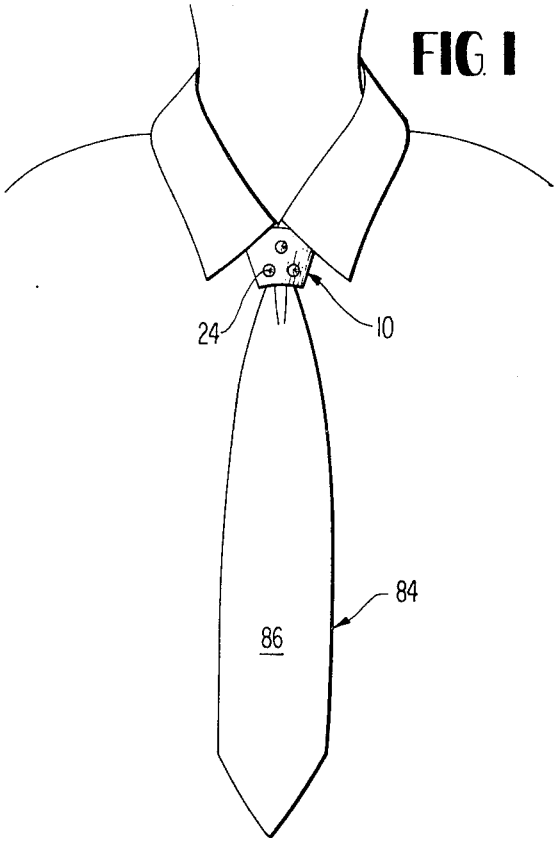
FIG. 1
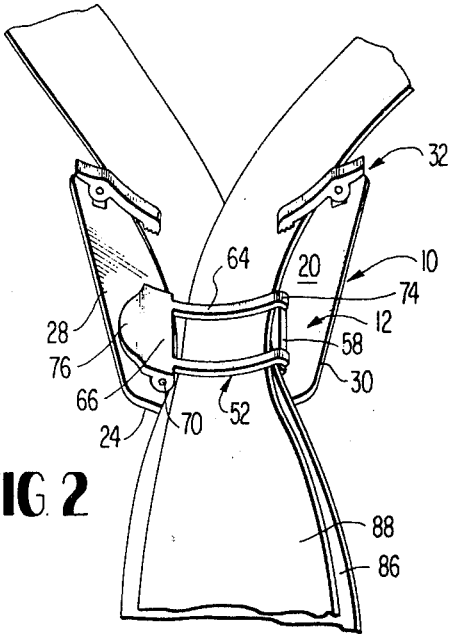
FIG. 2
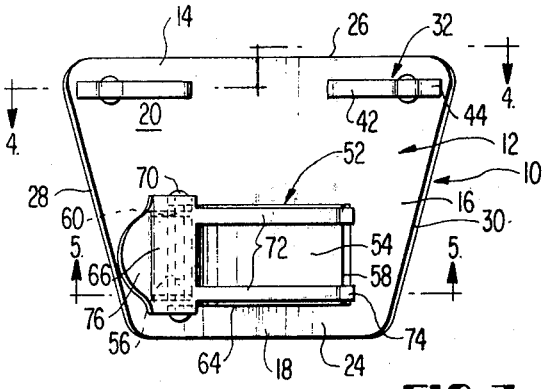
FIG. 3
FIG. 4
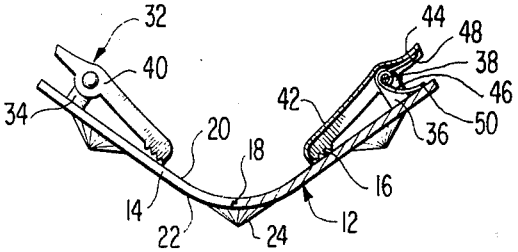
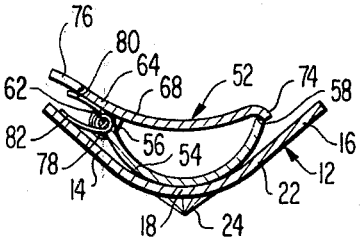
FIG. 5

KNOT SIMULATOR

BACKGROUND OF THE INVENTION

1. Field of the Invention

This invention pertains to an apparel accessory which is worn with a necktie, and which retains the tie in position and simulates a tied appearance. 2. Statement of the Prior Art Devices which are worn with neckties to achieve the general objectives of the present device have been heretofore proposed. Examples of these include those shown in the below listed U.S. Patents:

| Patent No. | Patentee | Issued |
|---|---|---|
| 2,735,105 | E. Traub | February 21, 1956 |
| 2,553,437 | W. R. Burke | May 15, 1951 |
| 2,022,346 | S. R. Hickok | November 26, 1935 |
| 2,349,842 | R. G. Barreto | May 30, 1944 |
| 2,099,901 | W. J. Morse | November 23, 1937 |
| 3,222,684 | H. Kanter et al. | December 14, 1965 |

SUMMARY OF THE INVENTION

This invention relates to a knot simulator which serves to decoratively enhance the appearance of a necktie and to maintain the tie in desired position without the necessity of forming a knot therein. This substantially increases the life of the tie, and also improves the neatness of the appearance of the wearer.

The device includes a shield which is preferably formed of material, such as precious metal, and which may be provided with jewels or other decorative items.

Earlier attempts to provide knot simulators of this general category have experienced difficulty in maintenance of the selected position of the retainer relative to the tie. The present invention provides a dual retaining system which holds the tie panels in the chosen superposed relation, and also clamps the individual tie panels to the device adjacent an entry position thereof.

Additional objects and advantages of the invention will become apparent to those skilled in the art from a consideration of the following specification when read in conjunction with the annexed drawing.

BRIEF DESCRIPTION OF THE DRAWING

FIG. 1 is a frontal view showing a knot simulator according to this invention in place;

FIG. 2 is an enlarged perspective view of the device from the rear;

FIG. 3 is a further enlarged rear elevation;

FIG. 4 is a view partially in cross section from line 4 — 4 of FIG. 3, looking in the direction of the arrows; and FIG. 5 is a sectional view on line 5 — 5 of FIG. 3.

DESCRIPTION OF THE PREFERRED EMBODIMENT

Referring to the drawing in more detail, the knot simulator hereof is generally identified therein by reference numeral 10. The device 10 includes a shield 12 formed of gold, silver or other suitable material. The shield 12 is unitary, but for purposes of description has side portions 14 and 16 which are related to one another at an obtuse angle along a central bend section 18. The shield has an inner surface 20 and an outer surface 22. Affixed in optional design variations to the outer surface 22 of the shield are decorative items 24, such as jewels.

The top edge 26 of the shield is elongated relative to the bottom edge 24, and these are connected by side edges 28, 30. This imposes a generally inverted triangular shape which simulates the outline form of a necktie knot.

Upper clip assemblies 32 are mounted on the inner surface 20 of each side portion adjacent the top dge 26 of the shield. These clip assemblies are identical to one another but oppositely disposed. Each includes a pair of upstanding leg members 34, 36, and a pivot axle 38 extends between the leg members to support a clip arm 40. The arms 40 have an elongated gripping section 42 which extends inwardly and also have outwardly projecting lever sections 44. The arms are pivoted on the axles and as shown in FIG. 4, a coil spring 46 extends about the axle and has ends 48 and 50 which engage against the underside of the lever section and the shield, respectively. This spring bias urges the gripping sections toward the shield.

A main clasp assembly 52 comprises a concave-convex plate 54 affixed to the shield inner surface with its concave side projecting therefrom. The plate has a pivot end 56 and a free end 58. The pivot end has slots 60 formed therein and also has a central bore 62. The assembly 52 further comprises a clasp member 64 including a cross bar 66 with depending ears 68. These ears are apertured and extend into the slots 60. A through pin 70 extends therethrough to pivotally mount the cross bar on the pivot end of the plate. A pair of elongated, curved retaining bars 72 extend from the cross bar. The retaining bars each have a downturned outer lip 74 which extends over the free end 58 of the plate when the bars are in clamping position. An actuating knob 76 extends from the opposite side of the cross bar. Coil springs 78 are also seated in the slots 60 and have spring ends 80, 82 which engage against the knob and the shield, respectively, to maintain the clasp in clamping position.

The device 10 is employed with a conventional necktie 84 which, when applied to a shirt collar, has forward and rear tie panels 86, 88. As shown in FIG. 2, these are substantially superposed over one another, and the main clasp is connected over the superposed panels. Thereafter, the individual panels are engaged by the clip assemblies 32 to maintain the selected position of the unit.

I claim:

1. A decorative necktie knot simulator for use with a necktie having first and second tie panels, the simulator comprising:

a shield of generally inverted triangular form having angularly related straight side portions connected together at a central bend section and extending therefrom at obtuse angles each of said side portions having inner and outer surfaces;

the shield having a top edge and a bottom edge, the top edge being elongated in relation to the bottom edge;

an upper clip assembly on the inner surface of each of the side portions adjacent the top edge of the shield;

each upper clip assembly comprising a pair of upstanding legs fixedly secured to the side portion, a pivot axle between said legs, a clip arm having an inwardly extended elongated gripping section and an outwardly extended lever section pivotally mounted on said axle between said gripping and lever sections, and a coil spring about the axle having spring ends contacting the lever section and the inner surface of the shield and constantly urging the gripping section against the shield;

a lower main clasp assembly comprising a concave/-convex plate fixedly secured to the inner surfaces of the shield side portions adjacent the bottom edge with the convex portion thereof in contact with the shield inner surface, the plate having a pivot end and a free end, a clasp member having a cross bar pivoted on said pivot end of the plate, an actuating knob extending from the cross bar, a pair of elongated, curved retaining bars extending from the cross bar across the shield, the retaining bars each having an outer lip which extends about the free end of the plate, and coil springs about the pivot end of the plate with spring ends contacting the shield inner surface and the actuating knob to urge the retaining bars against the plate; and the tie panels being positioned in knot simulating, superposed positions with the first and second tie panels in overlapping relation, one of the upper clip assemblies engaging each of the sections, and the lower clasp engaging the superposed tie panels.

* * * * *